US005791501A

United States Patent [19]

Baldwin, Jr.

[11] Patent Number: 5,791,501

[45] Date of Patent: Aug. 11, 1998

[54] SAFE SHELF RETAINER ASSEMBLY

[76] Inventor: A. Clayton Baldwin, Jr., 11 Coachlight Dr., Hannibal, Mo. 63401

[21] Appl. No.: 781,908

[22] Filed: Dec. 30, 1996

[51] Int. Cl.[6] ..... A47F 5/00

[52] U.S. Cl. ..... 211/183; 160/327; 211/180; 211/86; 108/27; 108/55.1

[58] Field of Search ..... 160/327, 330, 160/368.1; 108/27, 55.1; 256/19, 24; 211/86, 180, 183

[56] References Cited

U.S. PATENT DOCUMENTS

| | | | |
|---|---|---|---|
| 738,788 | 9/1903 | Frank . | |
| 2,553,980 | 5/1951 | Ostrander | 160/327 |
| 3,145,850 | 8/1964 | Ciboraoski . | |
| 3,752,324 | 8/1973 | Moser . | |
| 3,827,574 | 8/1974 | Craig, Sr. . | |
| 3,938,872 | 2/1976 | Hagerman . | |
| 4,053,008 | 10/1977 | Baslow | 160/327 |
| 4,197,686 | 4/1980 | Baslow | 160/327 X |
| 4,437,572 | 3/1984 | Hoffman . | |
| 4,800,947 | 1/1989 | Loomis | 160/368.1 |
| 4,893,668 | 1/1990 | Nomura | 160/368.1 X |
| 4,928,929 | 5/1990 | Kinder | 256/24 |
| 4,981,225 | 1/1991 | Cole | 211/183 |
| 5,180,143 | 1/1993 | Brower | 256/19 X |
| 5,402,988 | 4/1995 | Eisele | 256/19 X |
| 5,601,198 | 2/1997 | Reed | 211/183 |

*Primary Examiner*—Randolph A. Reese
*Assistant Examiner*—Robert J. Sandy
*Attorney, Agent, or Firm*—Don Halgren

[57] ABSTRACT

The present invention comprises a merchandise retaining assembly for the safe storage, viewing and access to merchandise on a store shelf, including a pair of vertically extending posts having an upper end and a lower end, the posts being attachable to a store shelf by securement means, a lower elongated rigid gripping member having a pair of elongated gripping portions facing toward one another and biased toward one another, and an upper elongated rigid gripping member having a pair of elongated gripping portions facing toward one another and biased toward one another. A securement bolt arrangement is provided for attaching said lower gripping member to said shelf. A flexible mesh screen is arranged between the upper and lower gripping members, and securement hooks are arranged for attaching the upper gripping member to the upper end of the posts, so as to provide a secure readily removable, replaceable boarder to a store shelf, protecting store customers and merchandise alike.

7 Claims, 2 Drawing Sheets

SAFE SHELF RETAINER ASSEMBLY

BACKGROUND OF THE INVENTION

1. Field of the Invention

This invention relates to a retainer assembly for a wall shelf, the retainer assembly to be utilized on a shelf in a store or market. The retainer assembly acts as a removable or displaceable barrier to prevent the falling of goods from the shelf.

2. Prior Art

The visibility, retreat ability/access and safe storage of goods has always been a concern to the merchandise retailer. Goods for sale have to be seen by the customer. Such goods have to be reasonably accessible to a store clerk or the customer. The maximum utilization of the space, including storage of those goods, and the retrieval from access points, such as shelves, is necessarily hazardous, because those goods may fall from raised shelves and injure a customer and damage the goods.

A number of attempts at providing retaining apparatus for shelves or storage compartments, may be seen in the following U.S. patents: U.S. Pat. No. 4,457,572 to Hoffman shows a shelf retainer comprising a rigid wire shelf, and a rigid outwardly pivotable fence or gate-like rack, to make retrieval from the items on that shelf. The fence pivots downwardly, but makes access to those items on the shelf very difficult; U.S. Pat. No. 3,938,872 to Hagerman shows a shelf retainer for mobile vehicle refrigerators, wherein a plurality of spaced apart elastic bands are supported between an upper and lower drawer, to prevent food articles from spilling out of a refrigerator. This sort of an apparatus would be difficult to move or access from a low floor position if such apparatus were on a high shelf; U.S. Pat. No. 3,827,574 to Craig, Sr. which shows a removable shelf edge fence, the fence being rigid and supported on a shelf through a plurality of clips extending from the lower edge of the shelf, into a plurality of space depart holds on the shelf. The entire fence has to be removed from the shelf, for access to any goods thereon, and those locating pins must be reinserted into the openings on the shelf. This would be difficult, if not impossible, if that shelf were above head level in a store without requiring a use of ladders or the like.

U.S. Pat. No. 3,752,324 to Moser shows a refrigerator shelf guard comprising a rigid fence-like arrangement of wires having a plurality of space depart hooks, which hooks mate into spaces within the wire shelves of a refrigerator. Again, the entire fence face has to be removed for ready access to any product there behind. This would be inconvenient and difficult, if the shelves were raised above floor level in a store. U.S. Pat. No. 3,145,850 to Ciborowski shows a store shelving with a removable front edge. Here again, the entire shelf must be removed for access to goods on the shelf. U.S. Pat. No. 738,788 to Frank shows a shelf guard and advertising medium for protecting goods on that shelf. The shelf guard is attached to the shelf by screws or the like. This arrangement would be inherently difficult for anyone to utilize, particularly if that shelf were spaced above a reasonable reach area in a store which is merchandising the goods to be sold.

Thus it is an object of the present invention, to provide a shelf good retaining apparatus which overcomes the disadvantages of the prior art.

It is a further object of the present invention to provide a shelf good retaining system which may be utilized by store personnel with minimal effort, equipment and time.

It is yet a further object of the present invention to provide a shelf retaining system which permits safe retainment of the goods on the shelf, while permitting customers to see just where those goods are. It is still a further object of the present invention, to provide a shelf retaining apparatus which is flexible, permits ventilation and sprinkler system use, flexibility as well as easy repair and/or replacibility, should any component of the system become worn or damaged.

BRIEF SUMMARY OF THE INVENTION

The present invention comprises an apparatus for the safe retaining of goods on a store shelf, comprising a pair of vertically arranged posts which are secured to spaced apart locations on a merchandising shelf. The apparatus also comprises a pair of spaced apart relatively longitudinally rigid elongated self-biasing frame members which engagingly grip a flexible mesh therebetween. The spaced apart gripper members are securable at the lower front edge of a store shelf, by screws, hooks or the like, the upper gripper member being readily attachable and disattachable from the upper edge of each post.

Each post may comprise an elongated structure having first and second side for rigidity and strength with a lower plate attached to each side, which plate is securable by bolts or the like, to the edge, end or corner of a store shelf, if the post is not already a part of the structure of the shelf apparatus. Each post has an upper end with a clip or hook disposed on its forward facing edge. The front side of the posts lie in or close to the plane of the front edge of the store shelf. In a further embodiment, it is intended that each post may be structurally part of the shelf support system, the gripper members and the mesh or screen being attachable thereto, as recited hereinbelow.

The lower gripper member comprises an elongated extruded plastic flexible sheet gripping component having an elongated flexible mesh gripping edges thereon, similar to that shown in co-pending U.S. patent applications Ser. Nos. 08/372,814 and 08/741,972, of Hoffman et al, each of which are incorporated herein by reference. The elongated biasable gripping member includes an elongated planar strap having a first end and a second end. Each end of the strap is securable by hooks, bolts or the like to a bolt hole (or hook) on the lower edge of each post (or shelf edge). Thus, the elongated lower gripper member is secured to the posts and/or to the lower edge of the store shelf and/or posts.

The upper gripper member may comprise a mirror image of the lower gripper member having a pair of spaced apart openings therethrough which correspond to the dimensions between the spaced apart hooks at their respective upper ends of the posts. A thin, flexible, expandable mesh plastic or wire screen or netting is disposed and pinched between the elongated gripping elements of the respective upper and lower gripping members. Alternatively, the screen may be comprises of plastic sheet with or without perforations or openings. Such plastic sheet without openings would be desirable where small parts, powders, and/or hazardous chemicals were being retained. In any case, preferably, the sheet, mesh screen or netting permits at least a limited stretching perpendicular to the upper and lower elongated gripping members, to permit flexure necessary to attach the upper gripping member to the hooks on the upper ends of each post, and to permit flexure necessary to conform to irregularly shaped objects on the shelf. The planar elongated strap to which the elongated gripping members are unitarily part of or attached thereto, provides a lip base onto which advertisement, labels, warnings or signs may be placed so that store personnel, customers or the like, may be aware of conditions, products, or other notices.

The elongated gripping members themselves comprise an elongated exclusion which each provides a pair of parallel spaced apart ridges which act upon and provide readily attachable and releasable (when need to change the net or gripping member(s)) pinching pressure against the flexible netting or mesh to provide those upper and lower pairs of spaced apart elongated pressure lines for easily securing and unsecuring said mesh to said lower bottom anchoring component. Such parallel spaced apart lines of pressure are similarly effected by the upper elongated gripping member.

Thus, what is shown, is a novel and unique shelf storage retainment system for the safe containment of articles on a store shelf in a raised location. The apparatus permits simple change of any worn or broken components, ready viewability of any products behind the flexible mesh, and easy retrieval of those products merely by lifting the upper elongated gripper member and the flexible mesh screen therewith off of the hooks on the upper ends of each of the posts. The flexible member may then be dropped to permit access to those products and thereafter the upper elongated gripper member is returned to the hooked position at the top of those posts. The gripper members may be opened by biasing the arms defining the lines of contact, away from the base of the elongated gripper members, to permit those parallel spaced apart lines of contact, to release the flexible screen/mesh from their elongated gripping engagement thereof and the new flexible mesh placed therewithin.

The invention thus comprises a merchandise retaining assembly for the safe storage, viewing and access to merchandise on a store shelf, including a pair of vertically extending posts having an upper end and a lower end, said posts being attachable to a store shelf by securement means; a lower elongated rigid gripping member having a pair of elongated gripping portions facing toward one another and biased toward one another; and an upper elongated rigid gripping member having a pair of elongated gripping portions facing toward one another and biased toward one another. A securement means is arranged for attaching the lower gripping member to the shelf or adjacent posts. A flexible sheet or mesh screen is grippable between the upper and lower gripping members, and securement means is provided for attaching the upper gripping member to the upper end of the posts or the edge of the next higher shelf, so as to provide a secure readily removable, replaceable boarder to a store shelf, protecting store customers and merchandise alike. The mesh screen may have openings therethrough, to permit viewing of goods retained thereby, and permit fire extinguishing capabilities therethrough. The upper gripping member may include a pair of spaced apart lines of engagement so as to pinch the mesh screen with two edges pressed against a base, yet be readily replaceable. The lower gripping member includes a pair of spaced apart lines of engagement so as to pinch the mesh with two edges pressed against a base, yet be readily replaceable. The securement means on the upper end of the posts may comprise a hook or clip to which the upper member may be readily attached and disattached. The securement means for attaching the lower gripping member to the shelf comprises an arrangement of bolts for attaching the gripping member to the lower end of the posts, the lower edge of the shelf, or hooks to releasably attach the lower gripper member to the lower end of those posts or lower edge of the shelves.

The invention also includes a method of providing a retaining system to a supply of goods on a store shelf, to protect clerks and shoppers from goods falling from a shelf, comprising: securing a pair of posts on the shelf, so as to establish ends for support of a flexible mesh screen therebetween; attaching an elongated gripping member having biased together gripper portions, between the lower ends of the posts; attaching a lower edge of a rectilinear flexible mesh screen to the gripper portions of the lower gripping member; gripping an upper edge of the mesh between a pair of gripping portions of an upper elongated gripping member; and attaching each end of the upper elongated member to a hook at the upper end of each of the posts, so as to secure the mesh on an open side of the shelf to maintain goods thereon, and keep them from falling off of the shelf. The method includes the step of placing a warning sign on a lower base lip of the lower gripping member to warn people of dangers of potentially falling goods.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
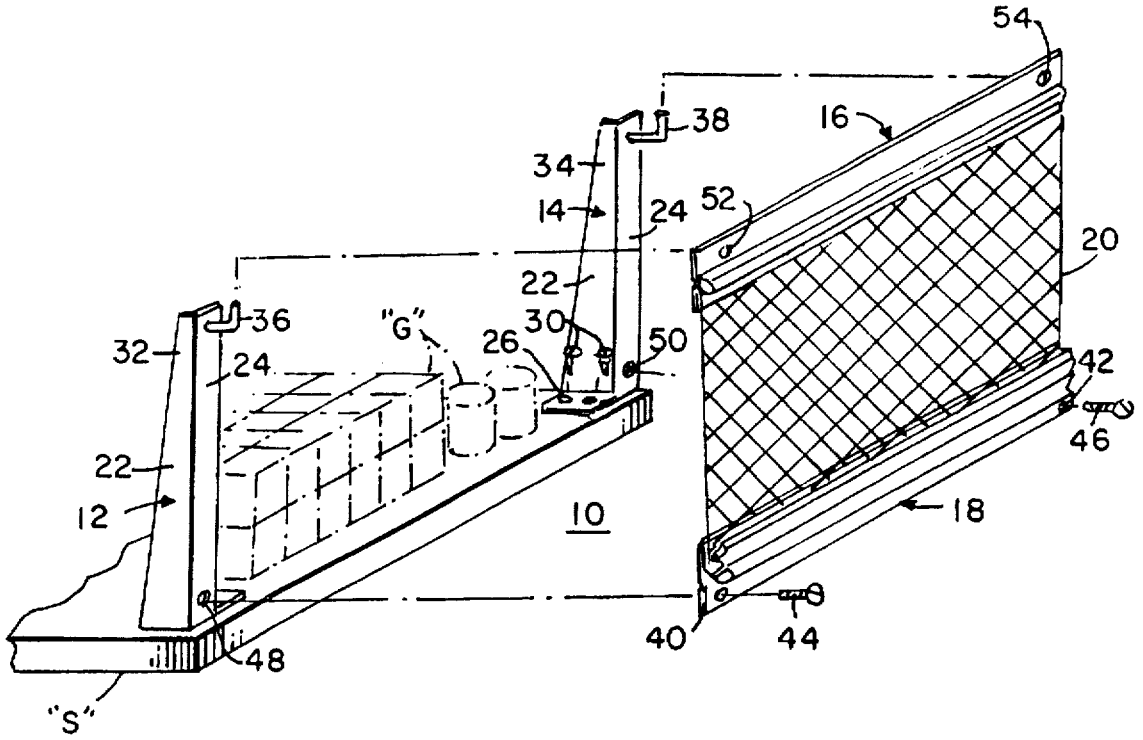
FIG. 1 is a perspective view of a shelf containment apparatus constructed according to the principles of the present invention.

Referring now to the present invention, and particularly to FIG. 1, there is shown a safe shelf containment apparatus 10 for the safe retaining of goods "G" on a store shelf, comprising a pair of vertically arranged posts 12 and 14 which are secured to spaced apart locations on a merchandising shelf "S", or those posts may comprises the typical posts which are arranged between different levels of shelves in a store. The containment apparatus 10 also comprises a pair of spaced apart easily replacable, relatively longitudinally rigid elongated self-biasing gripping frame members 16 and 18 which engagingly grip (pinch) a flexible sheet, mesh screen or net 20 therebetween. The spaced apart gripper members 16 and 18 are securable to the lower front edge of a store shelf "S", the upper gripper member 16 being readily attachable and disattachable from the upper edge of each post 12 and 14, to existing posts, not shown, or to the front edge of the next higher shelf.

Each post 12 and 14 may comprise an elongated structure having first and second side portions 22 and 24, for rigidity and strength, with a lower plate 26 attached to each side 22 and 24, which plate 26 is securable by bolts 30 or the like, to the edge, end or corner of the store shelf "S", if each post is not already part of the shelf support system. Each post 12 and 14 has an upper end 32 and 34 with a clip or hook 36 and 38 disposed on its forward facing side 24. Such front side 24 of the posts 12 and 14 lie in or close to the plane of the front edge of the store shelf.

The lower gripper member 18 comprises an elongated extruded plastic flexible "sheet gripping" component having an elongated flexible "mesh sheet" gripping edges thereon, similar to that shown in co-pending U.S. patent applications Ser. Nos. 08/372,814 and 08/741,972, of Hoffman et al, each of which are incorporated herein by reference. The elongated biasable gripping member 18 includes an elongated planar strap 39 having a first end 40 and a second end 41. Each end 40 and 41 of the strap 39 is securable by bolts 44 and 46 or the like, through a hole 45 in the strap 39, to a bolt hole 48 and 50 on the lower edge of each post 12 and 14. Thus, the elongated lower gripper member 18 is secured to the posts 12 and 14, and thus, to the lower edge of the store shelf "S" or posts. It is to be noted that the lower gripper member 18 could also be attached to the lower ends of the posts or the shelf edge, by hooks, not shown, thus allowing easy removal/replacement of an elongated gripper member therefrom as well.

Figure 2:
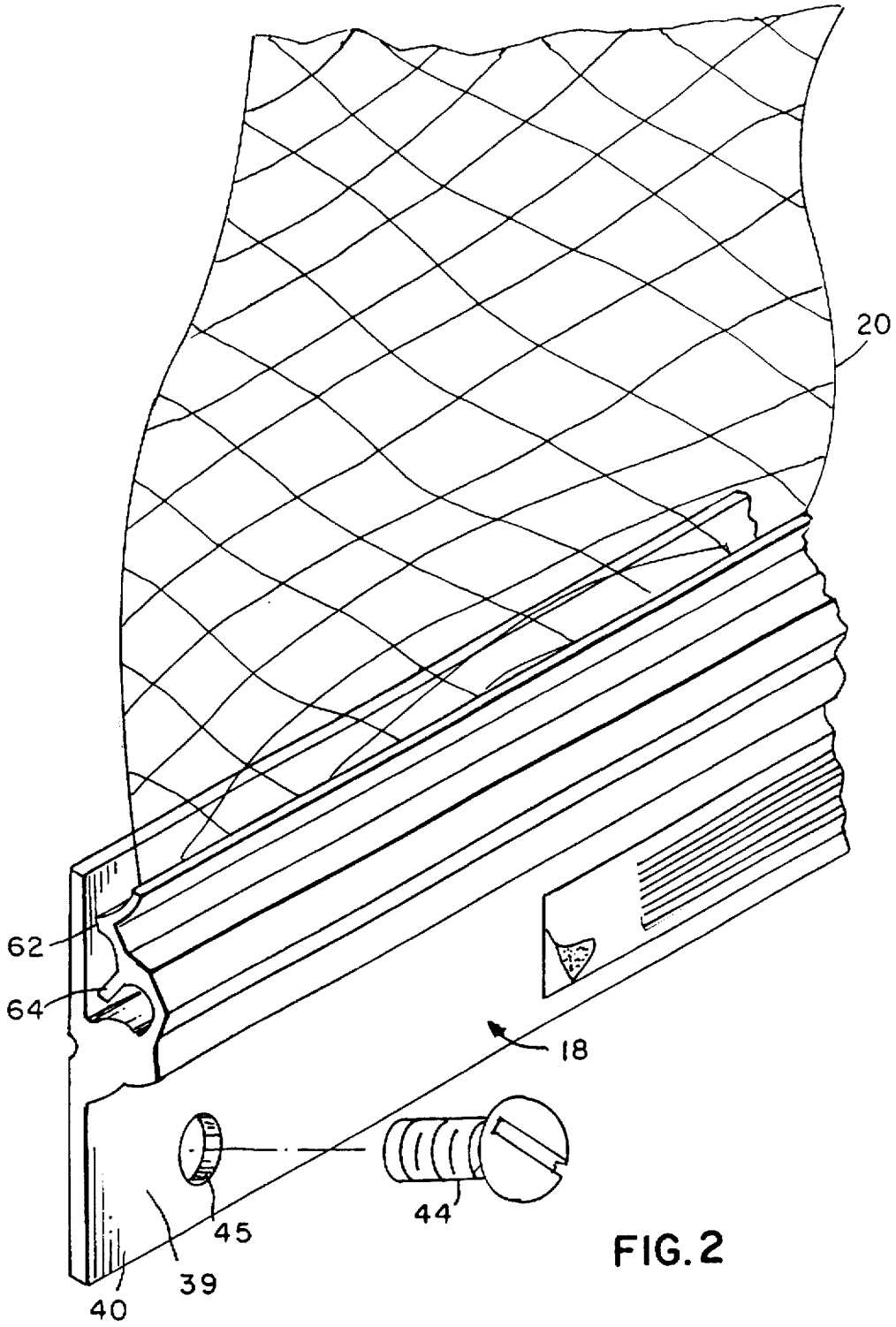
FIG. 2 is an enlarged view of a gripping component and a flexible mesh component of the present invention.

The upper gripper member 16 may preferably comprise a mirror image of the lower gripper member 18, having a pair of spaced apart openings 52 and 54 therethrough which correspond to the dimensions between the spaced apart hooks 36 and 38 at their respective upper ends 32 and 34 of the posts 12 and 14. The thin, flexible, expandable mesh plastic sheet or wire screen or netting 20 is disposed between the elongated biasedly closed gripping elements 62 and 64 of the respective upper and lower gripping members 16 and 18, as shown in FIG. 2. The mesh screen or netting 20 permits limited stretching perpendicular to the upper and lower elongated gripping members 16 and 18, to permit flexure necessary to attach the upper gripping member 16 to the hooks 36 and 38 on the upper ends 32 and 34 of each post 12 and 14, and to permit flexure necessary to conform to irregularly shaped objects on the shelf "S". The planar elongated strap 39 to which the elongated gripping members 62 and 64 are unitarily part of or attached thereto, provides a lip base onto which advertisement, labels, warnings or signs 68 may be placed so that store personnel, customers or the like, may be aware of conditions, products, or other notices.

The elongated gripping members themselves may comprise an elongated extrusion which provides the pair of parallel spaced apart ridges which each act upon and provide pressure against the flexible netting or mesh 20 to provide those pair of spaced apart elongated pressure lines for "double safely" securing said mesh to said lower bottom anchoring components 44 and 46. Such parallel spaced apart lines of pressure are similarly effect by the upper elongated gripping member 16.

Thus, what is shown, is a novel and unique shelf storage retainment system for the safe containment of articles on a store shelf in a raised location. The apparatus permits simple change of any worn or broken components, ready viewability of any products behind the flexible mesh, and easy retrieval of those products merely by lifting the upper elongated gripper member and the flexible mesh screen therewith off of the hooks on the upper ends of each of the posts. The flexible member may then be dropped to permit access to those products and the upper elongated gripper member returned to the hooked position at the top of those posts. The gripper members may be opened, to permit those parallel spaced apart lines of contact, to release the flexible mesh from their gripping engagement thereof and the new flexible mesh placed there within.

I claim:

1. A merchandise retaining assembly for the safe storage, viewing and access to merchandise on a store shelf, comprising:

a pair of vertically extending posts having an upper end and a lower end, said posts being attachable to a store shelf by securement means;

a lower elongated rigid gripping member having a pair of elongated gripping portions facing toward one another and biased toward one another;

an upper elongated rigid gripping member having a pair of elongated gripping portions facing toward one another and biased toward one another;

securement means for attaching said lower gripping member to said shelf;

a flexible mesh screen grippable between said upper and lower gripping members, securement means for attaching said upper gripping member to said upper end of said posts, so as to provide a secure readily removable, replaceable boarder to a store shelf, protecting store customers and merchandise alike;

wherein said securement means on said upper end of said posts comprise a hook or clip to which said upper member may be readily attached and disattached; and wherein said securement means for attaching said lower gripping member to said shelf comprises an arrangement of hooks or bolts for attaching said lower gripping member adjacent said lower end of said posts.

2. The merchandise retaining system as recited in claim 1, wherein said mesh screen has openings therethrough, to permit viewing of goods retained thereby, and fire extinguishing capabilities therethrough.

3. The merchandise retaining system as recited in claim 2, wherein said upper gripping member includes a pair of spaced apart lines of engagement so as to pinch said mesh with two edges pressed against a base, yet be readily replaceable.

4. The merchandise retaining system as recited in claim 3, wherein said lower gripping member includes a pair of spaced apart lines of engagement so as to pinch said mesh with two edges pressed against a base, yet be readily replaceable.

5. A method of providing a retaining system to a supply of goods on a store shelf, to protect clerks and shoppers from goods falling from a shelf, comprising:

securing a pair of posts on said shelf, so as to establish ends for support of a flexible mesh screen therebetween;

attaching an elongated gripping member having biased together gripper portions, between the lower ends of said posts;

attaching a lower edge of a rectilinear flexible mesh screen to said gripper portions of said lower gripping member;

gripping said an upper edge of said mesh screen between a pair of gripping portions of an upper elongated gripping member; and attaching each end of said upper elongated member to a hook at the upper end of each of said posts, so as to secure said mesh on an open side of said shelf to maintain goods thereon, and keep them from falling off of said shelf.

6. The method of claim 5, including the step of:

placing a warning sign on a lower base lip of said lower gripping member to warn people of dangers of potentially falling goods.

7. A merchandise retaining assembly for the safe storage, viewing and access to merchandise on a first store shelf, comprising:

a lower elongated rigid gripping member having a pair of elongated gripping pincher portions facing toward one another and biased toward one another;

an upper elongated rigid gripping member having a pair of elongated gripping pincher portions facing toward one another and biased toward one another;

lower securement means for attaching said lower gripping member to said shelf;

a flexible mesh screen grippably pinched between said upper and lower gripping members, upper securement means for attaching said upper gripping member to a plurality of posts attached to said first shelf, so as to provide a secure readily removable, replaceable boarder to a store shelf, protecting store customers and merchandise alike; and wherein said upper and lower securement means comprises a plurality of hooks arranged at upper and lower locations on each of said plurality of posts, on which to attach said upper and said lower gripping members.

* * * * *